United States Patent [19]

Veach

[11] 4,144,791

[45] Mar. 20, 1979

[54] MUSIC BOX WITH SELECTIVELY PROGRAMMABLE DRUM

[76] Inventor: Carlos W. Veach, 8921 Ashcroft Ave., Los Angeles, Calif. 90048

[21] Appl. No.: 905,987

[22] Filed: May 15, 1978

[51] Int. Cl.[2] ..... G10F 5/04

[52] U.S. Cl. ..... 84/96

[58] Field of Search ..... 84/94–96, 84/102–103, 402–408

[56] References Cited

U.S. PATENT DOCUMENTS

| | | | |
|---|---|---|---|
| 1,547,183 | 7/1925 | Steele | 84/404 X |
| 1,969,147 | 8/1934 | Paul | 84/95 |
| 2,557,061 | 6/1951 | Goldman | 84/94 |
| 2,812,680 | 11/1957 | Fedoryszyn | 84/96 X |
| 3,651,731 | 3/1972 | Horta | 84/95 |

FOREIGN PATENT DOCUMENTS

| | | | |
|---|---|---|---|
| 1000219 | 1/1957 | Fed. Rep. of Germany | 84/95 |

*Primary Examiner*—Lawrence R. Franklin

*Attorney, Agent, or Firm*—Victor C. Muller

[57] ABSTRACT

Music box of the rotatable drum type with removable reed actuating pins which may be selectively disposed for playing various compositions, characterized by a drum having a peripheral surface without apertures therein and an envelope or sleeve surrounding same containing the apertures for retaining the pins, the envelope being injection moulded of plastic material, the apertures being non-circular, such as square, and the pins being cylindrical and of uniform diameter at all sections thereof.

9 Claims, 8 Drawing Figures

MUSIC BOX WITH SELECTIVELY PROGRAMMABLE DRUM

BACKGROUND OF THE INVENTION

Music boxes of the rotatable drum type having projections for operating reeds, hammers, or other sound producing means, have long been known in the art and are usually provided with fixed position striker tabs, pegs, or pins which permit the playing of only a single musical composition. Refinements of such music boxes are also known or have been proposed in which the tabs may be disposed in desired arrangements on the drum, whereby various compositions may be played as selected by the user. U.S. Pat. Nos. 1,547,183 to Steele, 2,557,061 to Goldman, and 3,651,731 to Horta are exemplary of this type. The patents to Steele and Goldman, which probably bear the closest resemblance to the present invention, employ drums with angularly spaced rows of apertures in which pins may be placed in desired arrangement. Such constructions are costly of manufacture due to the large number of apertures which must be provided, requiring drilling and deburring operations or other time consuming manufacturing techniques, and the special form of pins required. The patent to Goldman is probably the more simple but still requires special shouldered pins to satisfy the requirement that the ends of the pins project like distances from the drum periphery.

SUMMARY OF THE INVENTION

The present invention obviates the requirement of providing a drum with pin receiving apertures by the provision of an apertured sleeve or envelope which surrounds and is secured to an apertureless drum and through which the ends of the pins extend. The pins are simplified in that they are of uniform diameter at all sections along their lengths, the smooth surface of the drum serving as a stop to locate their outer ends. The envelope is formed as an injection moulded element in a master die which may be repeatedly used for economical mass production.

A general object of the invention, accordingly, and consonant with the foregoing, is to provide an apertureless music box drum with an apertured envelope which retains pins in a selected arrangement.

Another object is to provide cylindrical pins of uniform diameter which may be located in precise positions by the smooth surface of the drum.

Another object is to provide an injection moulded envelope with apertures having three or more flat sides which receive right circular cylindrical pins with an interference fit.

Another object is to provide pins, either ends of which may be secured in the envelope apertures.

A further object is to provide hardened steel cylindrical pins which may be economically mass produced.

Still further objects, advantages, and salient features will become more apparent from the detailed description to follow, the appended claims, and the accompanying drawing, to now be briefly described.

DETAILED DESCRIPTION OF PREFERRED EMBODIMENTS

Figure 1:
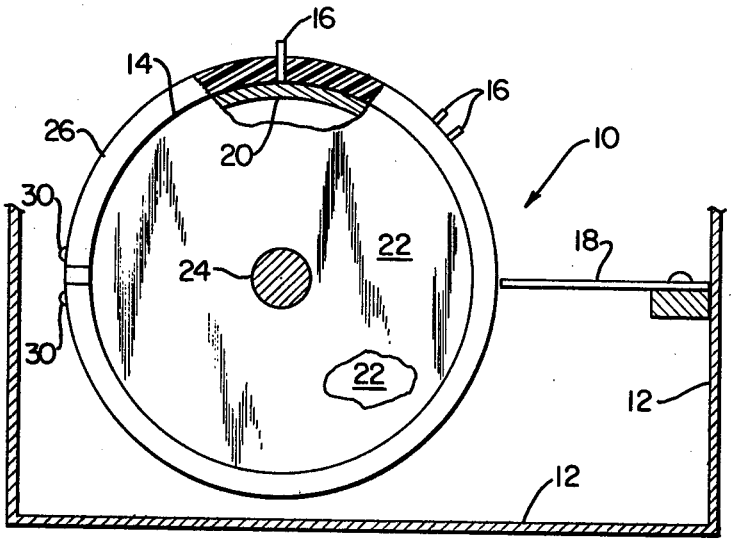
FIG. 1 is a section through a music box forming the subject of the invention, portions being broken away.

Referring now in detail to the drawing, and first to FIG. 1, the subject of the invention comprises, in general, a music box 10 including a frame or enclosure 12, a rotatable drum 14, having projecting pins 16, which engage a planar set of reeds 18. The drum may be formed as a right circular tube 20 having circular end plates 22,22 and a central shaft 24, supported for rotation and rotated at constant speed by a suitable motor, such as a spring motor (not shown) so that the pins 16 pass across the reeds and cause same to vibrate, all as is conventional in the art. The subject of the invention resides in a pin supporting envelope member 26 which surrounds and is affixed to the peripheral surface of drum 14.

Figure 2:
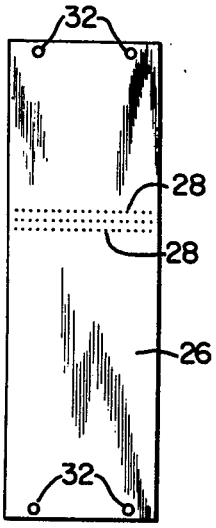
FIG. 2 is a developed plan, to reduced scale, of the cylinder pin holding envelope of FIG. 1.

Referring to FIG. 2, envelope 26 is rectangular and provided with apertures 28 extending therethrough and disposed throughout its area, a few of which are shown. As illustrated, there are nineteen apertures in each transverse row which may contain pins for actuating a like number of reeds which are tuned to full and half notes, thus providing about one and one half octaves. The ends of the envelope may be secured to the drum in any suitable manner, such as by drive pins 30 (FIG. 1) extending through apertures 32. The securement should be such that the inner ends of all pins 16 firmly abut the outer surface of the drum so that all of their ends move around a reference right circular surface to thereby uniformly engage and disengage the ends of the reeds. To attain this, of course, the surface of the cylinder must be concentric with its axis of rotation and the pins must be of uniform length.

The envelope material, the shape of the apertures extending therethrough, their interference fits with the cylindrical pins, and the economics and advantages of such construction will now be made more apparent, first by reference to an exemplary manner of constructing the envelope.

Figure 3:
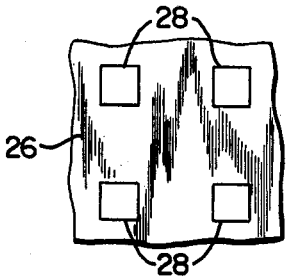
FIG. 3 is a greatly enlarged plan of a small portion of FIG. 2.
Figure 5:
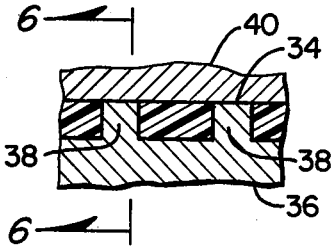
FIG. 5 is a section through a two-part mould employed for injection moulding the envelope.
Figure 6:
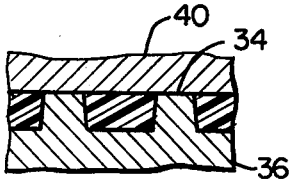
FIG. 6 is a section taken on line 6—6, FIG. 5.

Referring to FIGS. 5 and 6, the upper flat surface 34 of a mould block 36 is milled, shaped or otherwise machined away to leave spaced upstanding cores 38 which are square in cross section, the mating half 40 of the mould being planar. When material is injected into the spaces therebetween the envelope shown in FIGS. 1–3 is formed, this being rectangular and containing the transverse like rows of square apertures 28 extending therethrough and along its length which may selectively receive the cylindrical pins in a desired pattern to play a selected musical composition.

Figure 4:
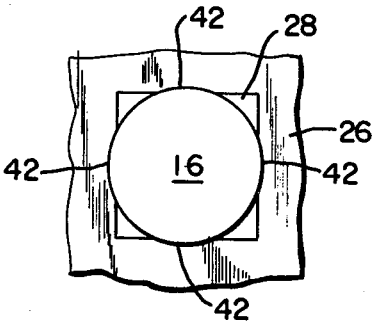
FIG. 4 is a greatly enlarged portion of FIG. 3, illustrating a cylindrical pin in a square aperture.

The purpose of employing square apertures for supporting the cylindrical pins will become more apparent from FIG. 4. As is well known, an interference fit of metal-to-metal may be of the order of 0.001" per inch of diameter. Pins 16 are quite small, and of the order of 0.035" (about 1/32"). The tolerance for an interference fit with a pin of such size would thus be far less than 0.001" and difficult to economically hold since, as is well known, manufacturing costs are dependent upon tolerances. The present invention obviates holding the tolerances which might be required with a metal-to-metal interference fit by constructing the envelope of material other than metal and providing a fit shape between the parts which obviates the conventional full surface contact. FIG. 4 illustrates a square aperture in a material of low modulus, such as nylon or other like plastic mouldable material, having a dimension across its flats which may be of the order of 0.002" less than the pin diameter (about 0.035"). This would be a difficult if not an impossible interference fit if the envelope were metal and the aperture were circular. With the square aperture, however, the envelope may locally distort or deflect in the loci of contacts 42, the deflection of material being permissive by reason of the corner voids between these loci which could not otherwise occur if the entire area around the pin were subjected to hoop tension as in a conventional metal-to-metal full surface fit. It will then become apparent that due to the selection of a material of low modulus, which permits greater strain or deflection under a given stress, thus permitting greater tolerance of strain within its limits, the dimensional tolerance between the pin and aperture may be increased over a metal-to-metal interference fit.

Figure 7:
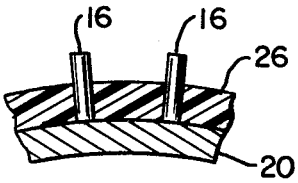
FIG. 7 is an enlarged section of a portion of the envelope surrounding the cylinder.

In the description of the construction of the mould, above, it was assumed that apertures 28 formed by cores 38 would remain of uniform cross section when the envelope is wrapped around the cylinder. This would be essentially so if the cylinder were quite large in diameter. An actual diameter contemplated, however, is about 2½" (by 2" long). To compensate for the distortion in such event, the cores are formed tapered at two opposite sides at the longitudinal axis of the envelope as shown in FIG. 6. When the flat envelope is then distorted to circular shape the tapered apertures widen somewhat at one end and similarly narrow at the other as shown in FIG. 7 wherein they are square and of equal dimensions at all sections of their lengths, that is, square parallelepiped.

Again referring to FIGS. 5 and 6, it will be apparent that if any minute "flash" of injected material occurs it can be only between the parting surface between the mould halves and particularly on top of cores 38. Such flash, if it occurs, need not be removed since it is at the outer end of an aperture and thus does not interfere with one end of a pin abutting directly on the surface of the drum, thus maintaining the dimensional integrity of the ends of the pins.

While nylon has been referred to as a material for the envelope, materials of like characteristics could be employed, within the purview of the invention. Such material should be non-metallic, have a low modulus of elasticity compared with metals, preferably be injection mouldable, rigidly retain the pins therein yet be susceptible of ready removal with pliers or tweezers, and be truly elastic or, if not, have "memory" to return to their unstressed exact original dimensions.

Figure 8:
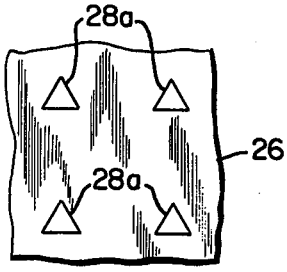
FIG. 8 is a plan, like FIG. 3, illustrating an alternative shape of pin aperture.

While rectangular apertures presently appear to be an ideal shape from a standpoint of manufacturing techniques and functional operability, other shapes are contemplated within the purview of the invention. FIG. 8 illustrates an aperture with three flat sides, for example, rather than four, which may retain a pin therein in like manner. With corners removed, this could also be hexagon shaped. A pentagon, while feasible, presents machining problems without adding advantages as would be shapes in excess of six sides which approach a circular hole requiring stressing about its entire periphery.

In the event the material is thermoplastic, like nylon, assembly may be facilitated by forming the flat envelope into a cylinder of slightly less diameter than the drum, and, after cooling, flexing it to slide onto one end of the drum. Depending upon its fit, additional fastenings 30 may or may not be required, or alternatively, cement may be employed to prevent unauthorized removal of same.

While forming the envelope as a flat developed cylinder presently appears to be an expedient manufacturing technique, it will become apparent that the envelope may be otherwise formed, such as an endless sleeve.

A "cylinder" as hereinafter referred to, is to be construed in its technical sense as a space (or solid) generated by moving a closed figure parallel to itself along an axis perpendicular to its plane. Thus, a triangle, square, hexagon, etc. all generate cylinders when so moved.

What I claim is:

1. In a music box of the type including a rotatable cylindrical drum with music note actuating pins projecting from the peripheral surface thereof, the pins being selectively attachable to the drum in a desired pattern whereby different musical compositions may be played, the improvements, in combination, comprising;

(a) an annular pin supporting member of substantially uniform thickness disposed on the peripheral surface of the drum, (b) said member being formed of material having a relatively low modulus of elasticity compared to metal, (c) said member having a plurality of spaced transverse rows of identical apertures extending therethrough, (d) each aperture being defined by at least three flat intersecting surfaces forming a cylindrical space of uniform polygonal cross section, and (e) a plurality of identical circular cylindrical pins of uniform diameter and length, (f) each pin being of a diameter such that it may removably engage intersecting surfaces of an aperture only at their central portions and with an interference fit therewith, (g) the outer surface of the drum forming a stop for the inner end of each pin.

2. A music box in accordance with claim 1 wherein said apertures are square in cross section.

3. A music box in accordance with claim 1 wherein said member and the apertures therein is formed as a substantially flat rectangular sheet by injection moulding and is thence formed into circular cylindrical shape to conform to the peripheral surface of the drum.

4. A music box in accordance with claim 3 wherein said apertures are tapered between opposite faces of the member, when moulded, and are cylindrical between said faces when formed to cylindrical shape.

5. A music box in accordance with claim 3 wherein the moulding flash, if any, is disposed at the outer surface of the member and remote from the surface of the drum, whereby a pin may abut the drum without interference of flash therebetween.

6. A music box in accordance with claim 3 wherein the material of the sheet is thermoplastic and is formed to the circular shape under elevated temperature.

7. A music box in accordance with claim 6 where the material of the sheet is nylon.

8. A music box cylinder, comprising:

(a) a drum having an imperforate peripheral surface, (b) an annular pin supporting member of substantially uniform thickness disposed on the peripheral surface of the drum, (c) said member being formed of material having a relatively low modulus of elasticity compared to metal, (d) said member having a plurality of spaced transverse rows of identical apertures extending therethrough, (e) each aperture being defined by at least three flat intersecting surfaces forming a cylindrical space of uniform polygonal cross section, (f) a plurality of identical circular cylindrical pins of uniform diameter and length, each pin being of a diameter such that it may removably engage intersecting surfaces of said each aperture at only their central portions and with an interference fit therewith, the outer surface of the drum forming a stop for the inner end of each pin.

9. Apparatus in accordance with claim 8 wherein said apertures are square in cross section.

* * * * *